US012672711B2

(12) United States Patent
Landis et al.

(10) Patent No.: US 12,672,711 B2
(45) Date of Patent: Jul. 7, 2026

(54) UNI-DIRECTIONAL SLIDING ROTATIONAL WORK SURFACE WITH INDEXING PIN

(71) Applicant: Owl Overland Outfitters LLC, Gettysburg, PA (US)

(72) Inventors: Tanner J. Landis, York, PA (US); Zachary R. Hartzell, Atlanta, GA (US)

(73) Assignee: Owl Overland Outfitters LLC, Gettysburg, PA (US)

( * ) Notice: Subject to any disclaimer, the term of this patent is extended or adjusted under 35 U.S.C. 154(b) by 0 days.

(21) Appl. No.: 18/305,844

(22) Filed: Apr. 24, 2023

(65) Prior Publication Data

US 2025/0248508 A1 Aug. 7, 2025

Related U.S. Application Data

(60) Provisional application No. 63/369,856, filed on Jul. 29, 2022.

(51) Int. Cl.
*A45F 3/00* (2006.01)
*A45F 3/46* (2006.01)

(52) U.S. Cl.
CPC ..... *A45F 3/46* (2013.01)

(58) Field of Classification Search
CPC .. A45F 3/46; A45C 11/20; A47J 47/16; B60P 3/36; B60P 3/34; B60R 11/06; B60R 2011/004
USPC ..... 296/37.5
See application file for complete search history.

(56) References Cited

U.S. PATENT DOCUMENTS

| | | | | |
|---|---|---|---|---|
| 11,466,861 | B2 * | 10/2022 | Gross | A47J 47/16 |
| 12,311,825 | B1 * | 5/2025 | Wang | B60P 3/36 |
| 2022/0055545 | A1 * | 2/2022 | Cooper | B60P 3/34 |

* cited by examiner

*Primary Examiner* — Steven O Douglas
(74) *Attorney, Agent, or Firm* — Penn State Dickinson Law; Jonathan D'Silva

(57) ABSTRACT

A portable kitchen assembly has a drawer assembly mounted on a primary slide. The drawer assembly has multiple working surfaces and a secondary slide. A first working surface mounted on the secondary slide. The secondary slide is oriented perpendicularly to the primary slide to allow the first working surface to slide away from the primary slide.

4 Claims, 10 Drawing Sheets

UNI-DIRECTIONAL SLIDING ROTATIONAL WORK SURFACE WITH INDEXING PIN

BACKGROUND

Cooking food outdoors is an important part of the outdoor camping experience. While some people revel in "roughing it" in the outdoors, others find the ability to take a functional and familiar kitchen with them wherever they go provides comfort and freedom that is different from traditional outdoor cookouts. There are a variety of options that incorporate kitchen appliances that are stored in the back of vehicles that are deployed linearly to create a kitchen layout in the outdoors. Currently, linear layouts are the only available options for kitchen deployment methods in vehicles and the general outdoors. Current solutions have limited functionality and do not focus on ergonomics that are common to a home kitchen. Therefore, there is a growing demand for a portable kitchen assembly that provides the ergonomics of home kitchens, versatile functionality, and compact storage for comfortable and easy cooking anywhere. Being able to transport the traditional working triangle layout found in most indoor kitchens to the outdoors brings luxury and comfort to the outdoor setting.

SUMMARY

What is presented is a portable kitchen assembly comprising a drawer assembly mounted on a primary slide. The drawer assembly further comprises of multiple working surfaces and a secondary slide. The first working surface is mounted to the secondary slide. The secondary slide is oriented perpendicularly to the primary slide to allow the first working surface to slide away from the primary slide. The secondary slide also has a locking pin for immobilizing the secondary slide relative to the primary slide when the secondary slide is deployed. The first working surface is rotatable on the secondary slide using a rotating mechanism.

The portable kitchen assembly has a stored configuration and deployed configuration. The stored configuration involves the secondary slide being fully retracted onto the drawer assembly and the drawer assembly being fully retracted into the portable kitchen assembly. The deployed configuration involves the drawer assembly being fully extended from the portable kitchen assembly and the secondary slide being fully extended from the drawer assembly The portable kitchen assembly also has a secondary drawer on top of the drawer assembly.

The features, functions, and advantages of the present invention can be achieved independently in various embodiments of the present inventions or may be combined in yet other embodiments. Although specific features, structures, embodiments, methods, objectives, benefits, advantages, functionality, and applications may have been disclosed, it will be understood by those having skill in the art that changes, including but not limited to, variations, modifications, combinations, alterations, omissions, and various other applications, will occur to those of ordinary skill in the art and such changes will be made without departing from the spirit and the scope of the invention as claimed. It should also be understood by anyone who reads this document that the terminology and phraseology used herein are for the purpose of description and should not be considered limiting.

BRIEF DESCRIPTION OF THE DRAWINGS

The features and the inventive aspects of the present invention will become more apparent upon reading the following detailed description, and drawings, of which the following is a brief description.

DETAILED DESCRIPTION

Figure 1:
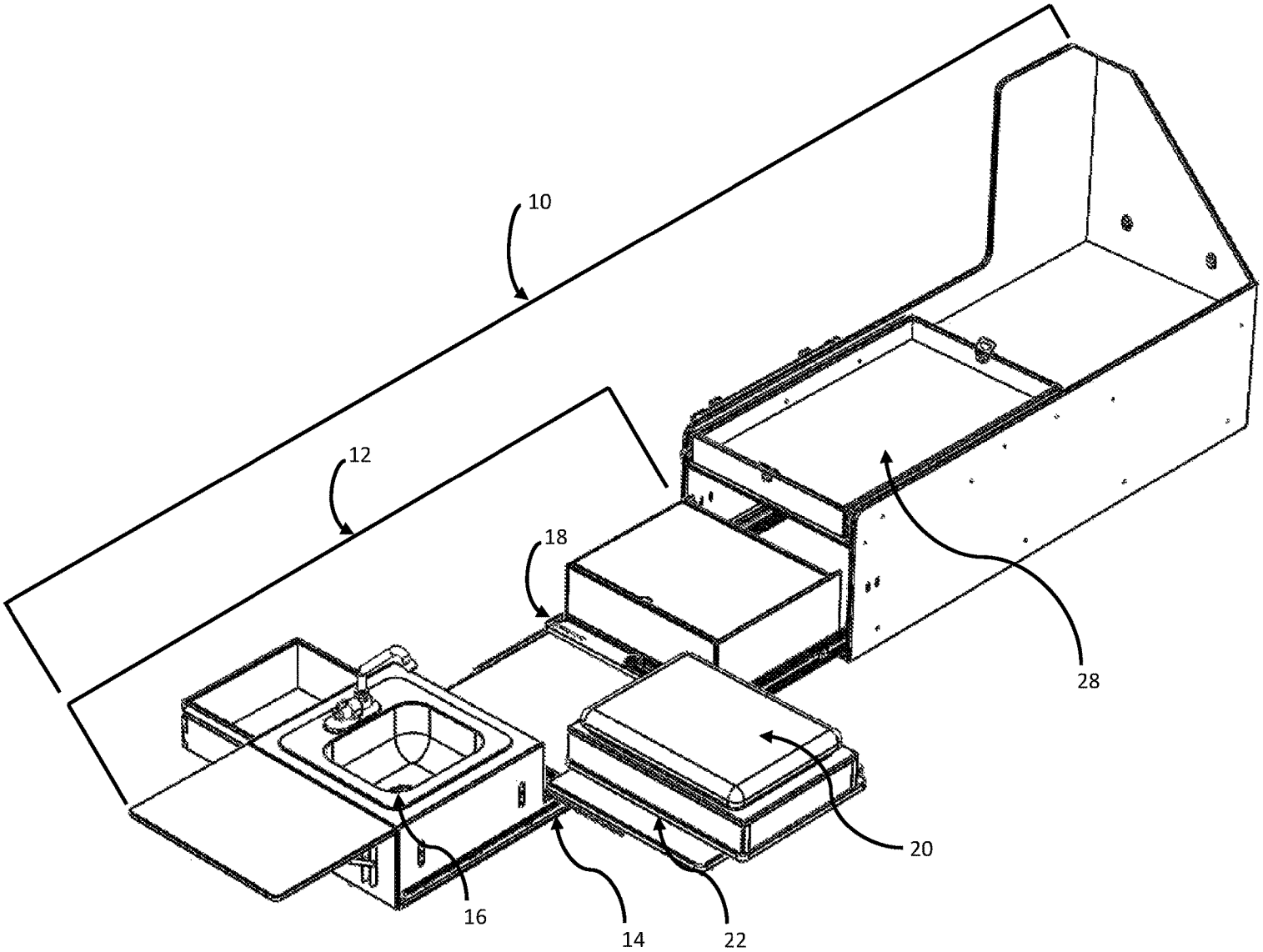
FIG. 1 illustrates one embodiment of the portable kitchen assembly deployed.

Referring to the drawings, some of the reference numerals are used to designate the same or corresponding parts through several of the embodiments and figures shown and described. It will be understood that variations in the embodiments can generally be interchanged without deviating from the invention.

Figure 6:
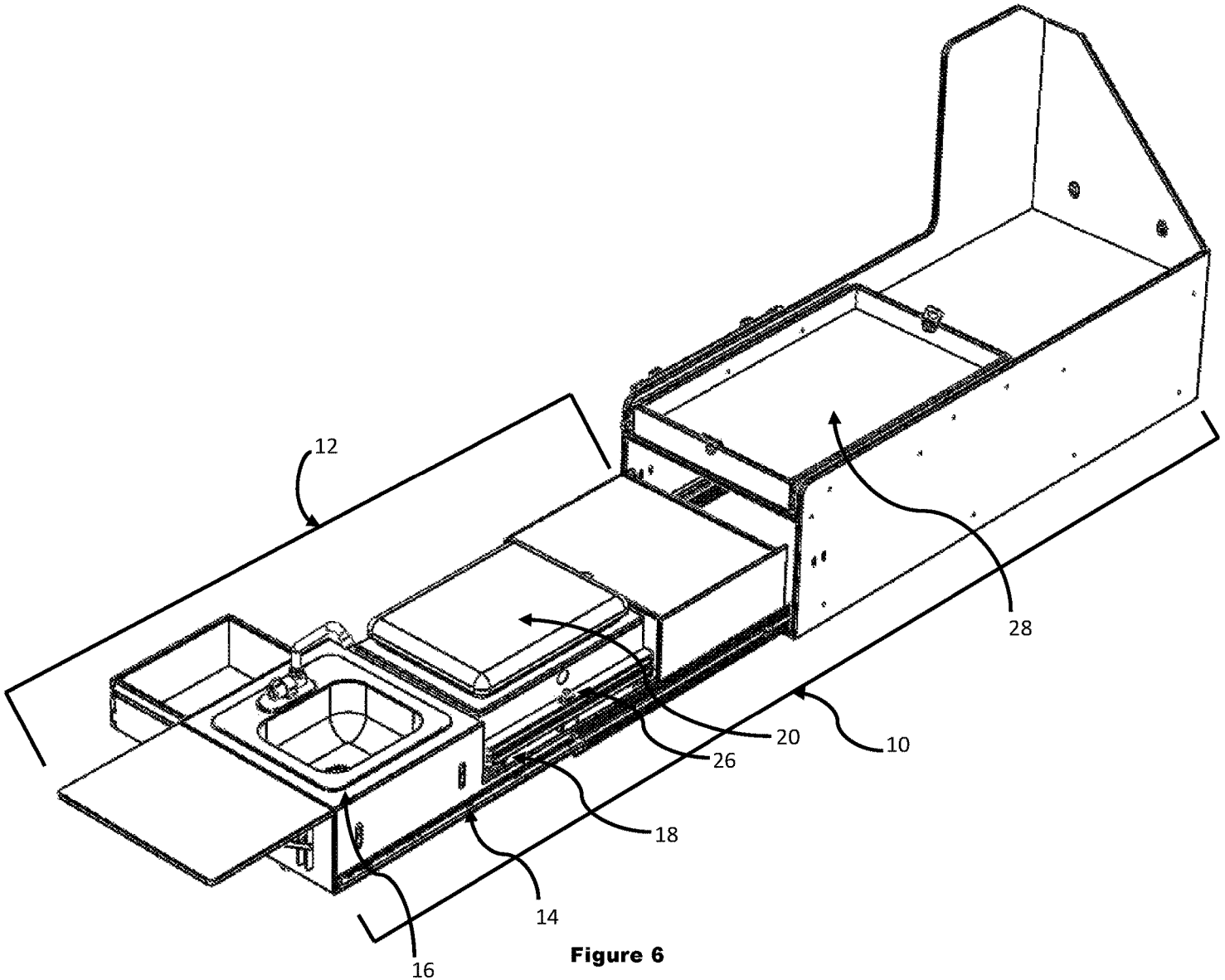
FIG. 6 illustrates one embodiment of the portable kitchen assembly in a partially deployed configuration in which the primary slide is fully deployed but the secondary slide is fully retracted.

Some people want the option to cook outside as comfortably and easily as they do in their own home kitchen. What is presented is a portable kitchen assembly that can be installed into the back of a vehicle or used in a general outdoor setting to bring the comforts of a home kitchen outside. FIGS. 1 and 6 show the portable kitchen assembly 10 in different stages of deployment. The figures show a drawer assembly 12 mounted to a primary slide 14. The drawer assembly 12 slides away from the portable kitchen assembly 10 to reveal multiple working surfaces 16 that can be anything the user finds most useful. For example, one embodiment of the portable kitchen assembly 10 are working surfaces 16 of a sink and a stove. Working surfaces 16 may also include any other common kitchen appliance such as a cutting board, a storage unit, and more. The figures show that one of the multiple working surfaces 16 is mounted on a secondary slide 18. Specifically, the first working surface 20 is mounted on the secondary slide 18. The secondary slide 18 is oriented perpendicularly to the primary slide 14 to allow the first working surface 20 to slide away from the primary slide 14. The perpendicular orientation allows for the creation of a working triangle as is common in a home kitchen.

Figure 2:
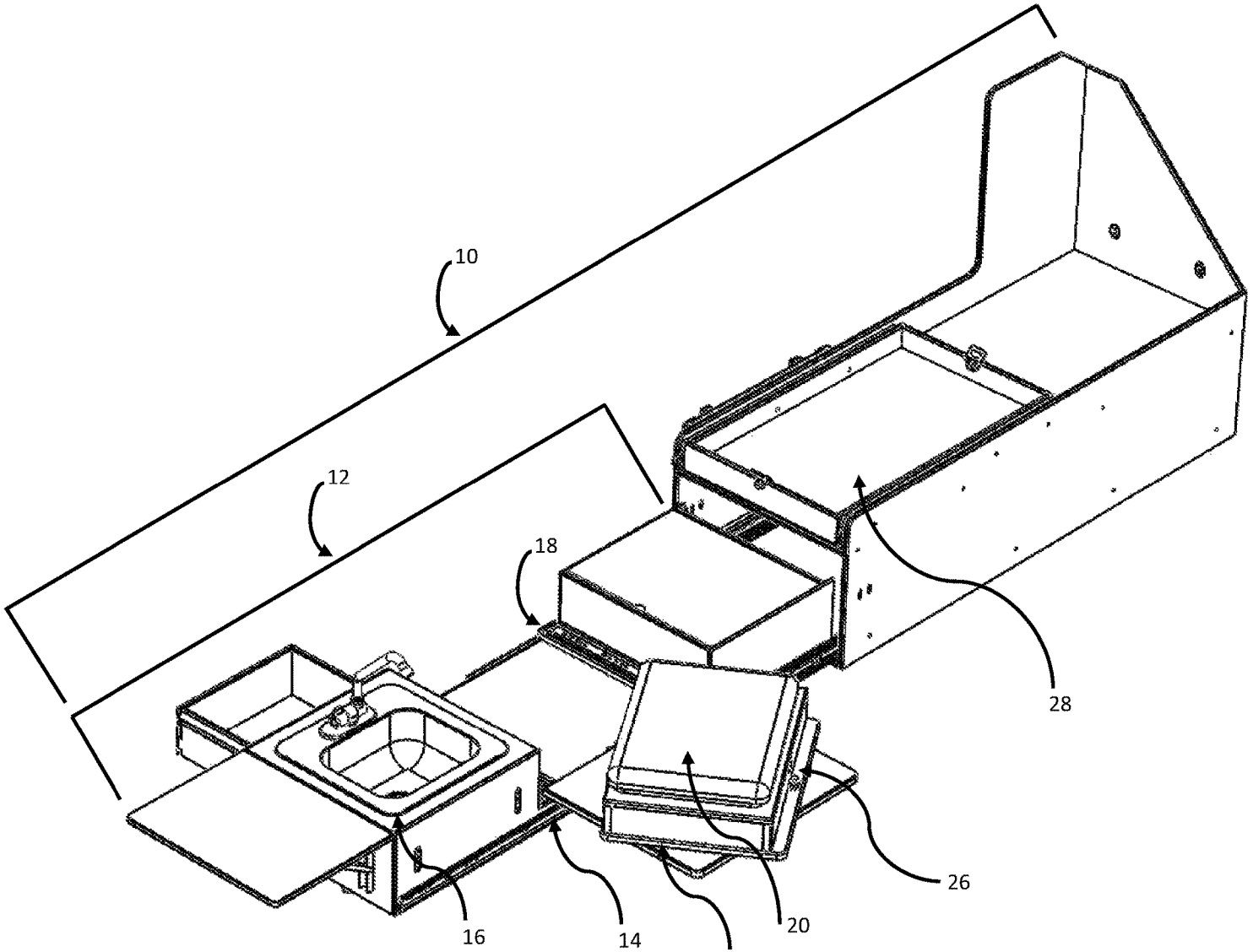
FIG. 2 illustrates the portable kitchen assembly of FIG. 1 with the first working surface rotated at another angle.
Figure 3:
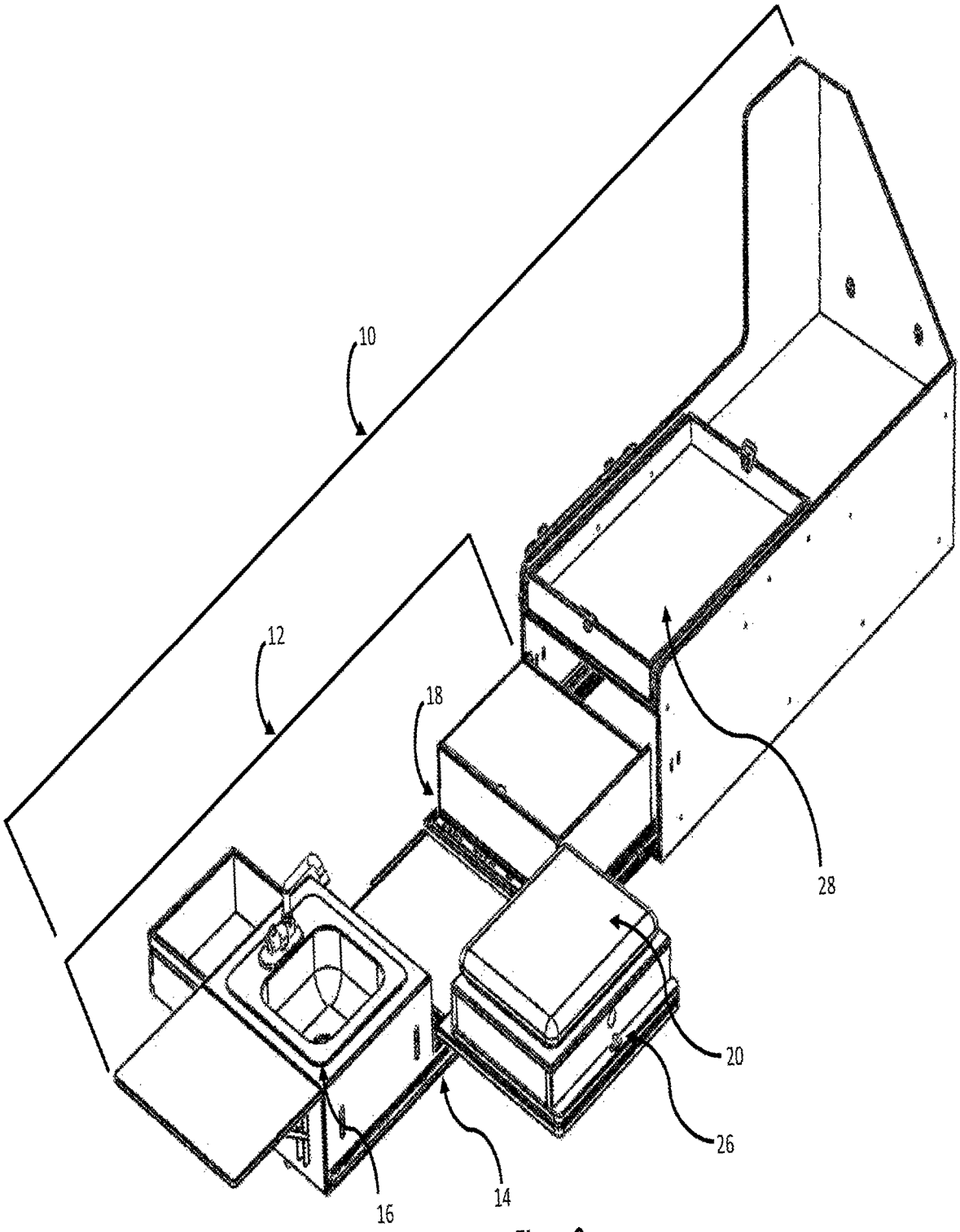
FIG. 3 illustrates the portable kitchen assembly of FIG. 1 with the first working surface rotated 180 degrees.
Figure 4:
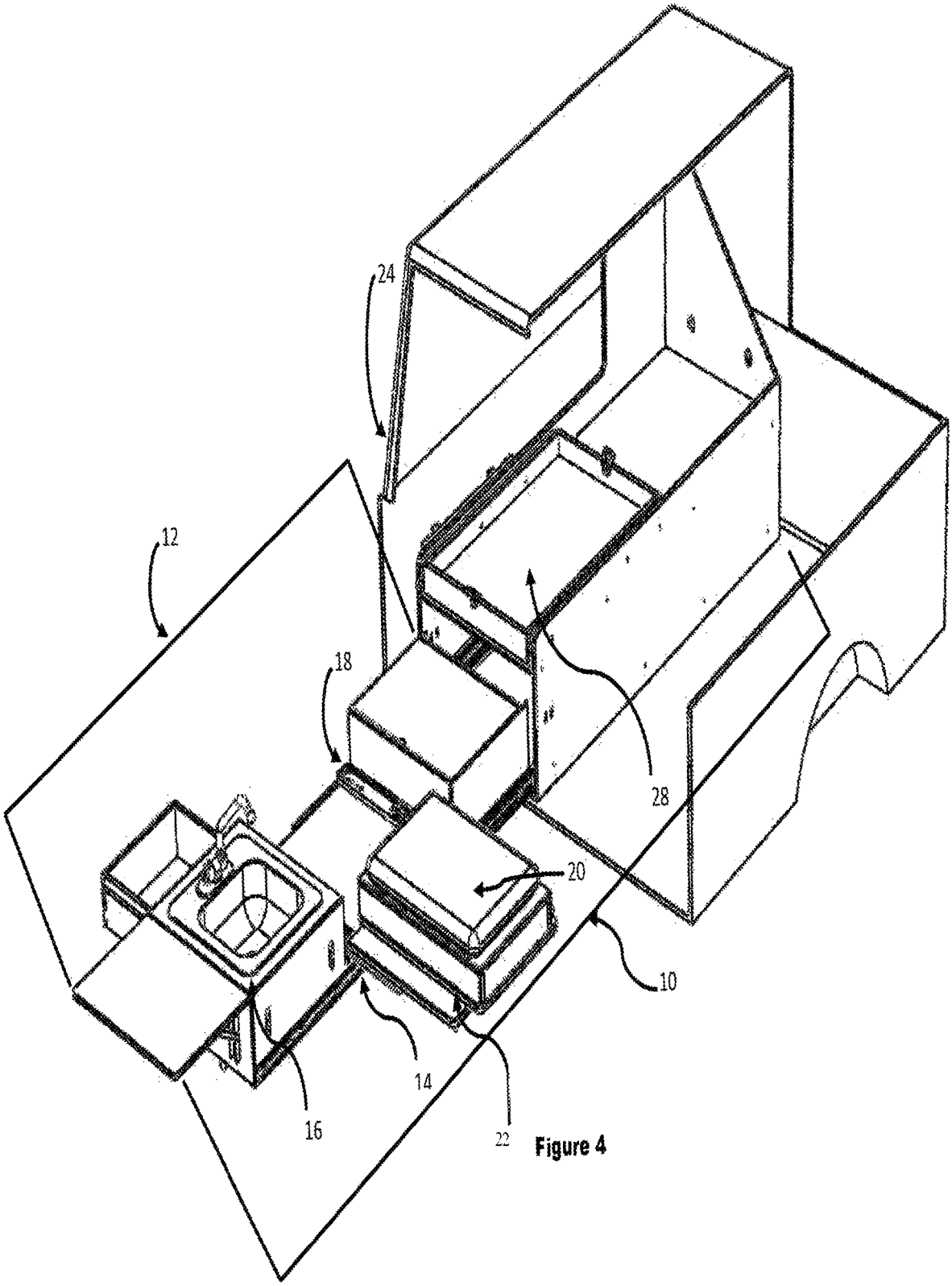
FIG. 4 illustrates the portable kitchen assembly of FIG. 1 installed in the trunk of a vehicle.
Figure 7:
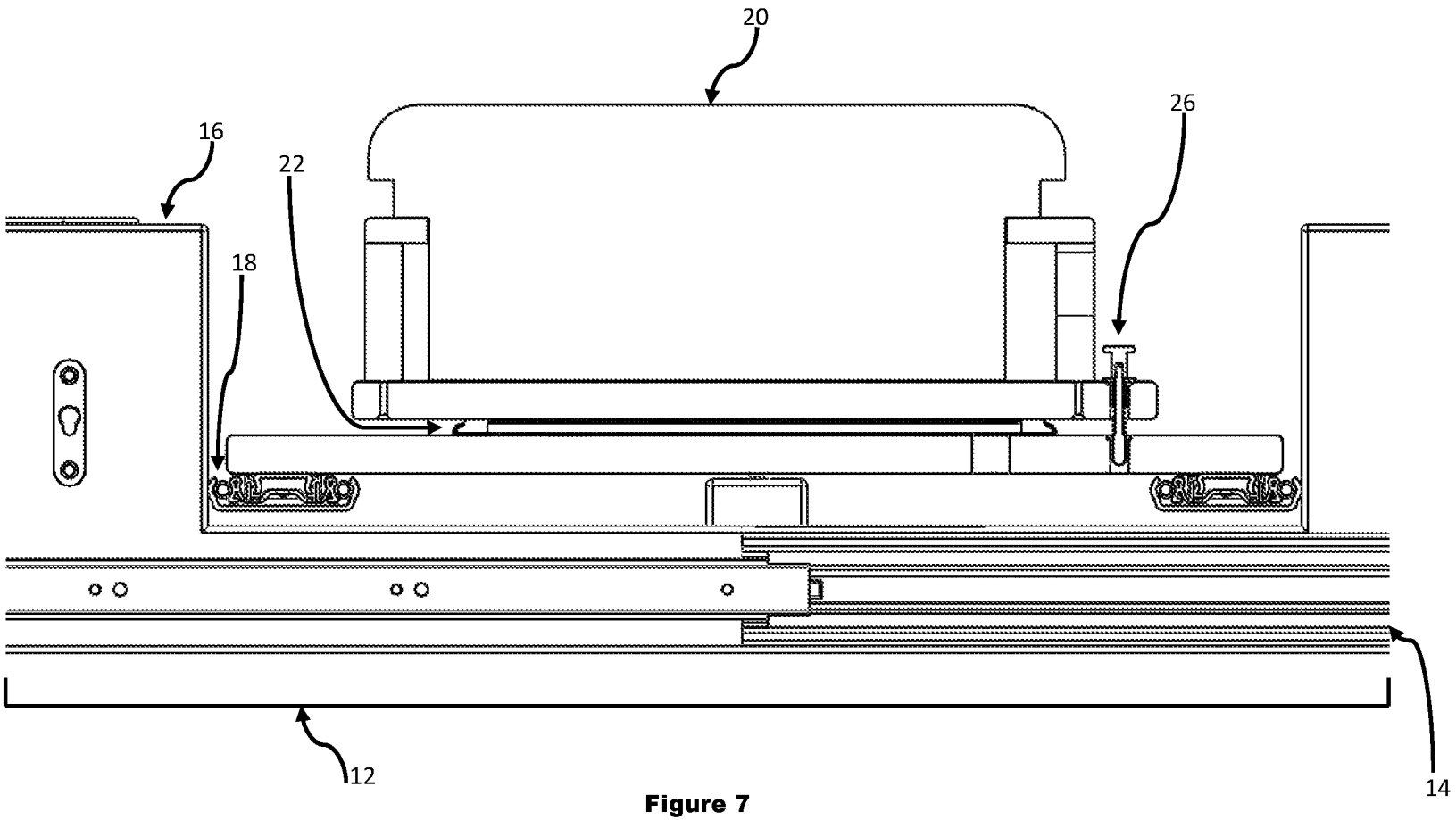
FIG. 7 illustrates a close-up, horizontal side view of the portable kitchen assembly of FIG. 6, which specifically shows the indexing pin when the secondary slide is fully retracted.
Figure 8:
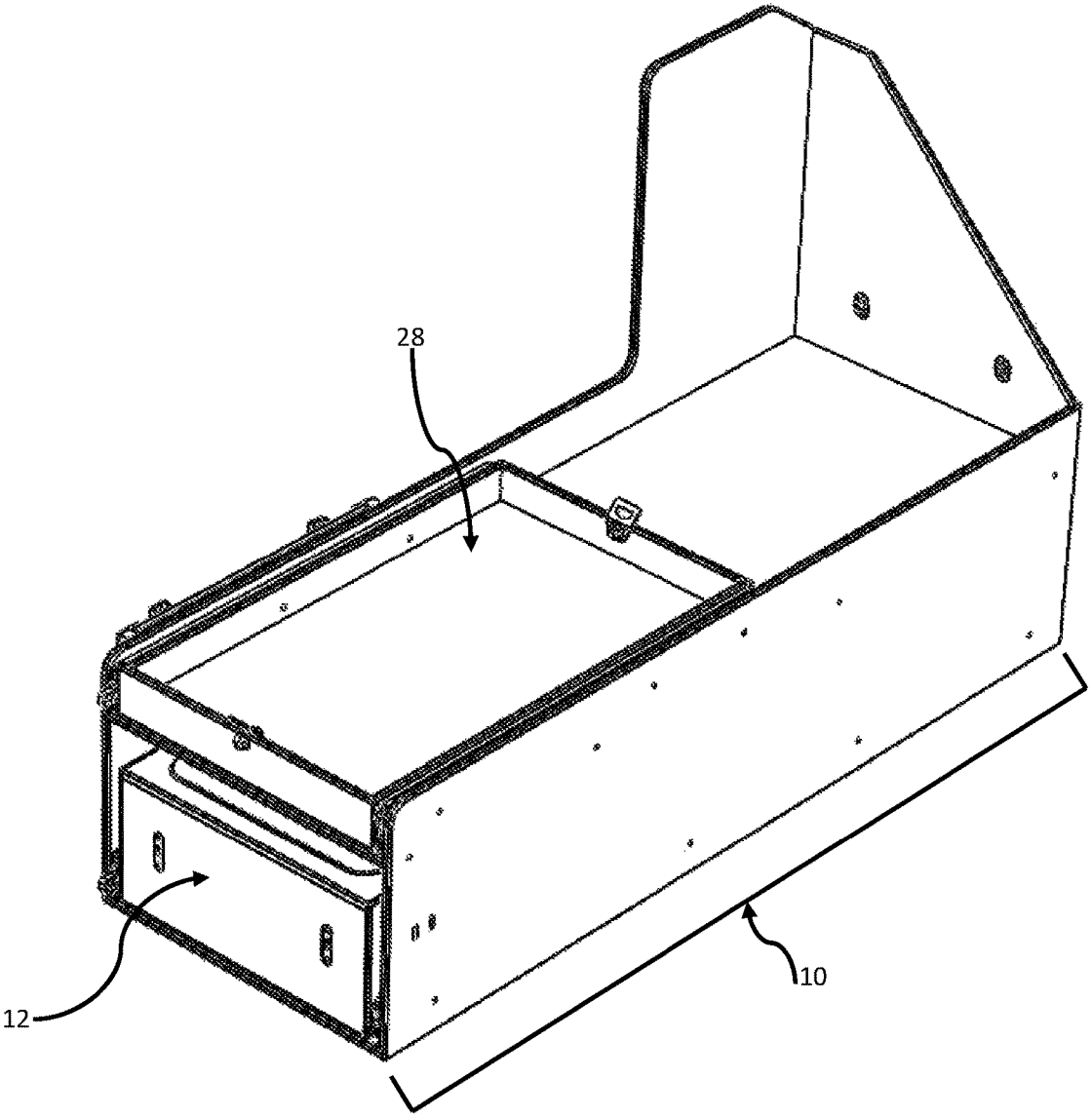
FIG. 8 illustrates one embodiment of the portable kitchen assembly in a stored configuration.
Figure 9:
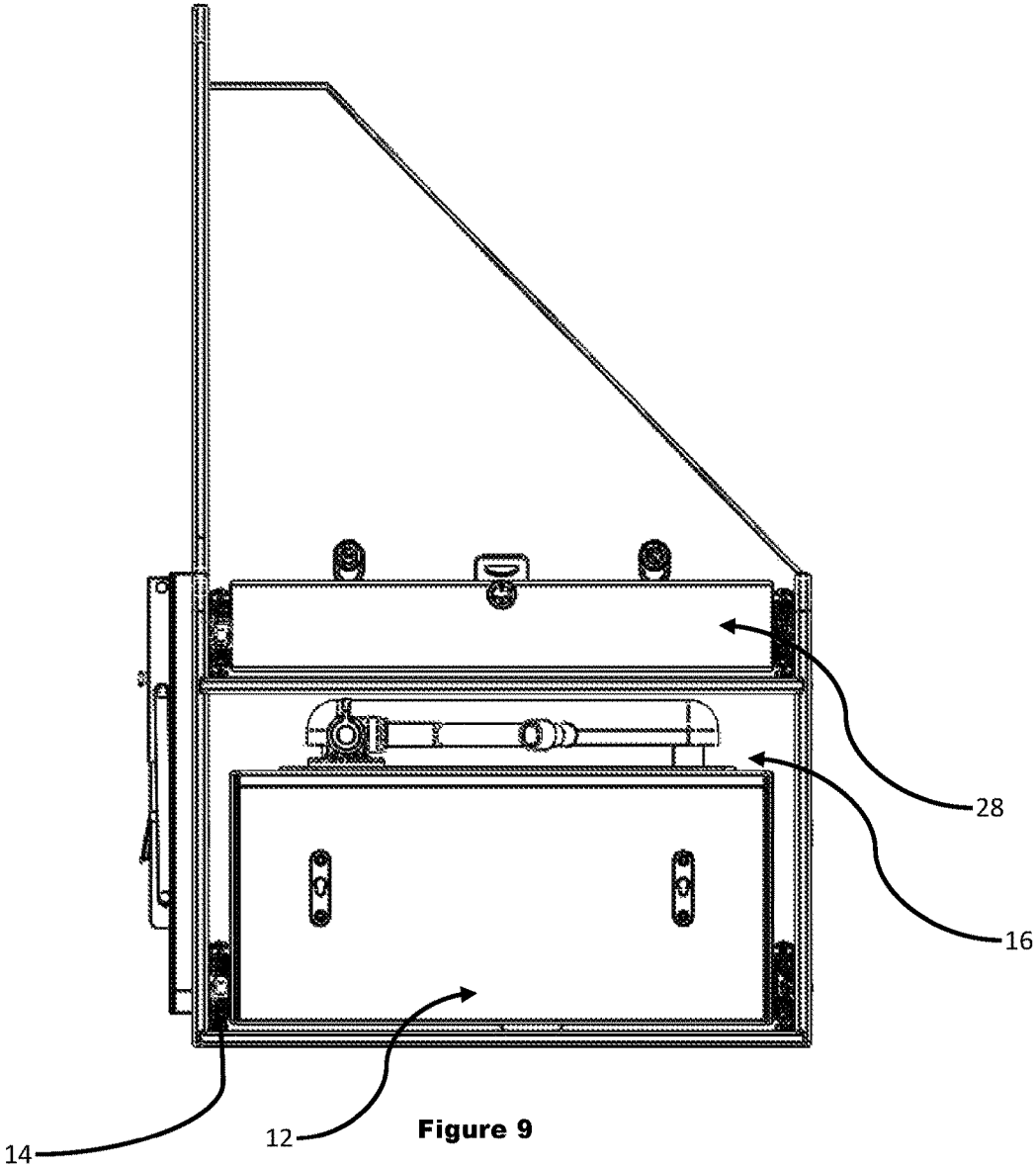
FIG. 9 illustrates a horizontal front view of the portable kitchen assembly of FIG. 8.
Figure 10:
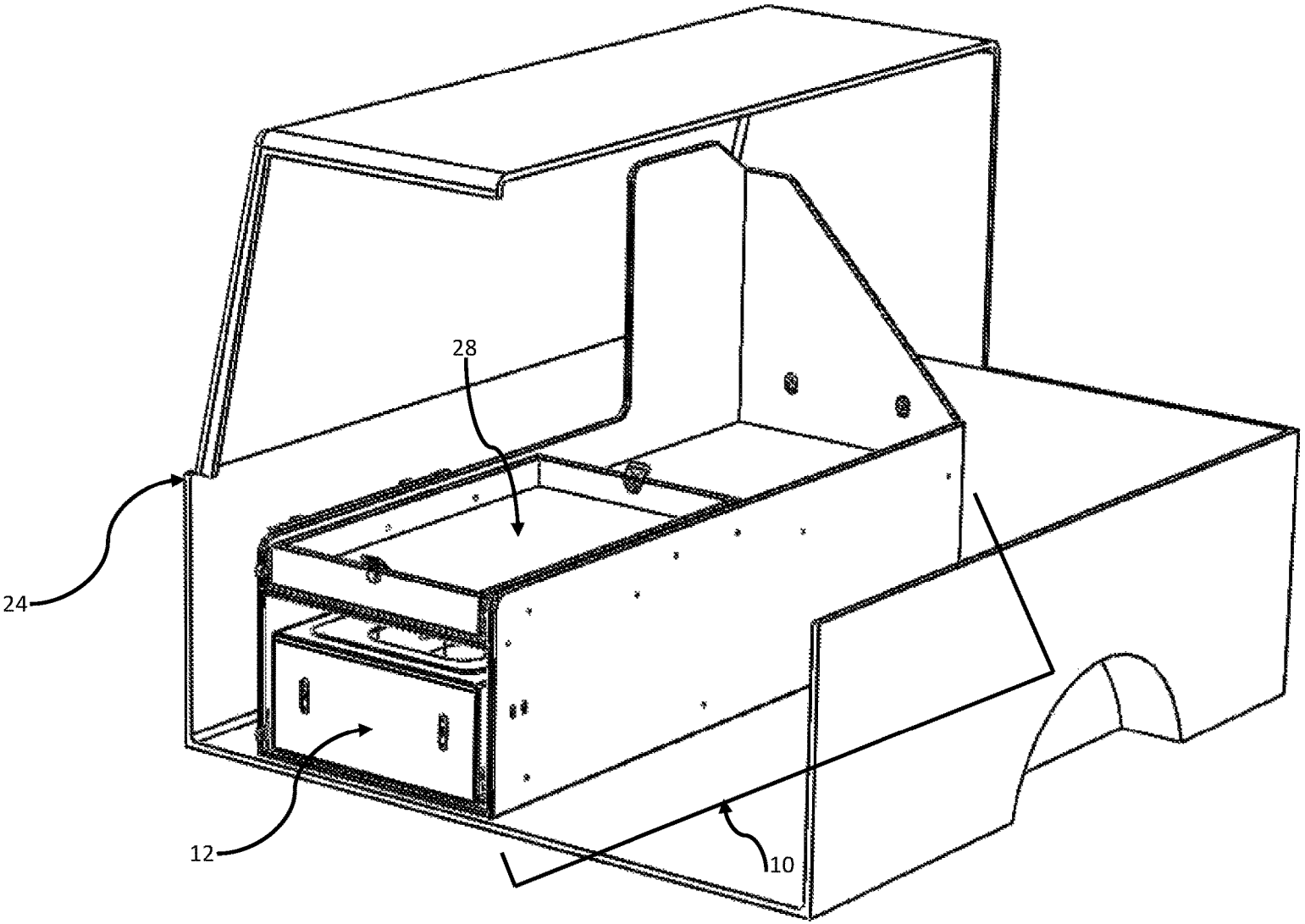
FIG. 10 illustrates the portable kitchen assembly of FIG. 8 installed in the trunk of a vehicle.

FIGS. 1 through 3 show the first working surface 20 rotated at different positions using a rotation mechanism 22 located on the secondary slide 18. The rotation mechanism 22 can be anything that allows easy 360 rotation of the first working surface 20 such as a Lazy Susan. FIGS. 1 through 7 demonstrate the deployed configuration of the portable kitchen assembly 10. In the deployed configuration, the drawer assembly 12 is fully extended from the portable kitchen assembly 10. The deployed configuration can involve the secondary slide 18 being fully extended from the primary slide 14, as shown in FIGS. 1 through 5, as well as the secondary slide 18 being fully retracted onto the drawer assembly 12, as shown in FIGS. 6 and 7. FIGS. 8 through 10 demonstrate the stored configuration of the portable kitchen assembly 10. In the stored configuration, the secondary slide 18 is fully retracted onto the drawer assembly 12 and the drawer assembly 12 is fully retracted into the portable kitchen assembly 10. The stored configuration allows for easy, compact storage and transportation of the portable kitchen assembly 10. FIGS. 4 and 10 demonstrate how the portable kitchen assembly 10 can be installed into the back of vehicle 24. However, the portable kitchen assembly 10 is not limited to use in a vehicle 24 and can be used in any outdoor space as well.

Figure 5:
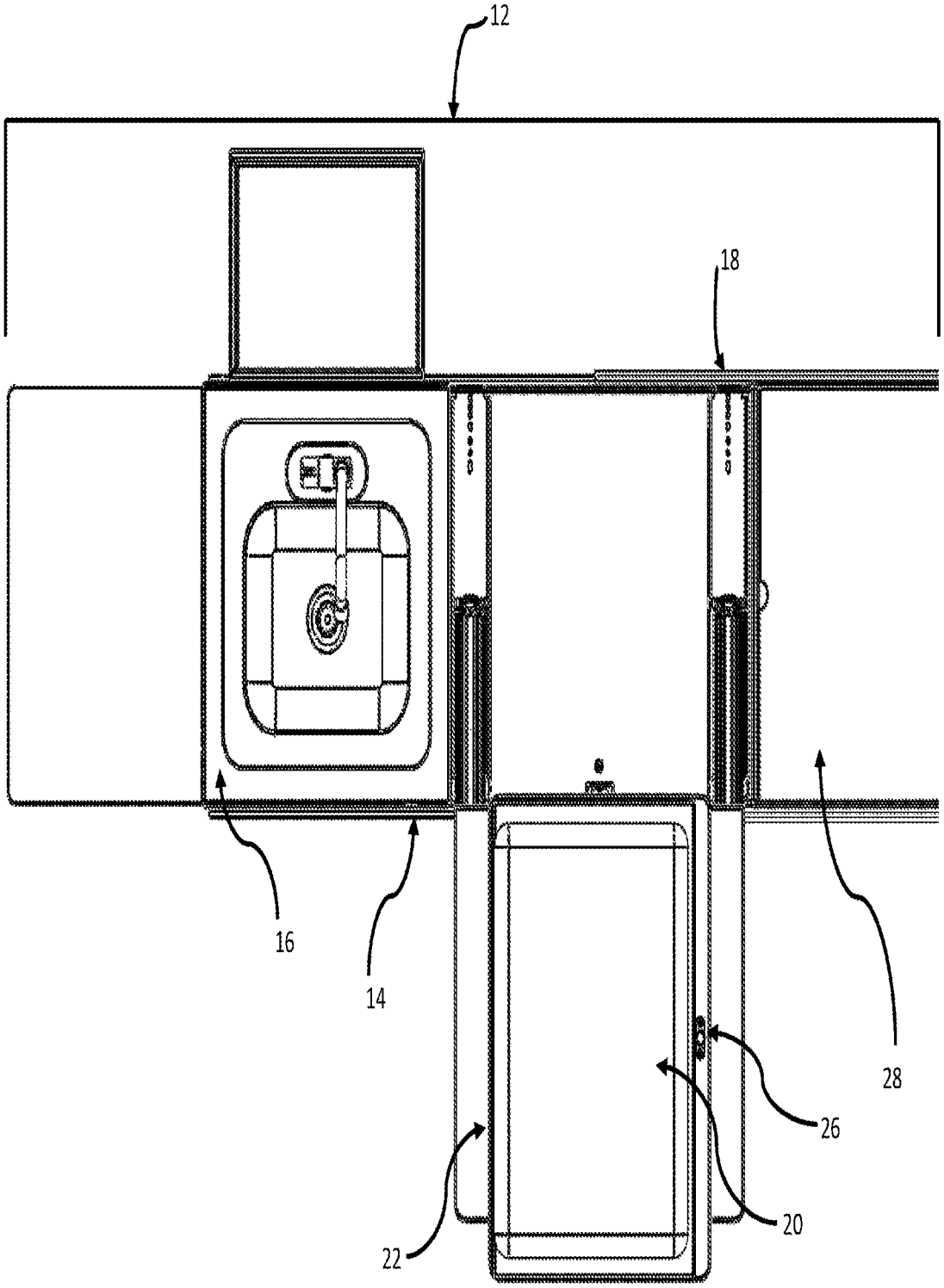
FIG. 5 illustrates a top, close-up view of the drawer assembly of the portable kitchen assembly of FIG. 1.

FIGS. 2, 3, and 5 through 7 show a locking pin 26 on the secondary slide 18. FIGS. 2, 3, and 5 show the locking pin 26 used to immobilize the secondary slide 18 relative to the primary slide 14 when the secondary slide 18 is deployed. The locking pin 26 prevents unwanted collapsing or retraction of the secondary slide 18 during use when a vehicle 24 is parked on an uneven surface. Moreover, the locking pin 26 locks the first working surface 20 at the desired position of rotation on the rotation mechanism 22. FIGS. 1 through 6 and 8 through 10 show a secondary drawer 28 above the drawer assembly 12. The secondary drawer 28 allows for storage of multiple working surfaces 16, tools, a fridge, and various other objects to make full use of space in a vehicle 24 and any outdoor setting.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claimed is:

1. A portable kitchen assembly, comprising:

a drawer assembly mounted on a primary slide;

said drawer assembly further comprises multiple working surfaces and a secondary slide;

a first working surface mounted on said secondary slide;

said secondary slide oriented perpendicularly to said primary slide to allow said first working surface to slide away from said primary slide; and said first working surface is rotatable on said secondary slide using a rotating mechanism.

2. The portable kitchen assembly of claim 1, further comprising a locking pin for immobilizing said secondary slide relative to said primary slide when said secondary slide is deployed.

3. The portable kitchen assembly of claim 1, further comprising said drawer assembly has a stored configuration and a deployed configuration wherein in said stored configuration said secondary slide is fully retracted onto said drawer assembly and said drawer assembly is fully retracted into said portable kitchen assembly and in said deployed configuration said drawer assembly is fully extended from said portable kitchen assembly and said secondary slide is fully extended from said drawer assembly.

4. The portable kitchen assembly of claim 1, further comprising a secondary drawer above said drawer assembly.

* * * * *